US009771770B2

(12) United States Patent
Al-Mulhem

(10) Patent No.: US 9,771,770 B2
(45) Date of Patent: Sep. 26, 2017

(54) VIBRATOR SUB

(71) Applicant: Saudi Arabian Oil Company, Dhahran (SA)

(72) Inventor: Abdulrahman Abdulaziz Al-Mulhem, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 604 days.

(21) Appl. No.: 14/061,020

(22) Filed: Oct. 23, 2013

(65) Prior Publication Data

US 2014/0110134 A1 Apr. 24, 2014

Related U.S. Application Data

(60) Provisional application No. 61/717,476, filed on Oct. 23, 2012.

(51) Int. Cl.

| | |
|---|---|
| ***E21B 28/00*** | (2006.01) |
| ***E21B 23/00*** | (2006.01) |
| ***E21B 23/14*** | (2006.01) |

(52) U.S. Cl.

CPC ..... *E21B 28/00* (2013.01); *E21B 23/00* (2013.01); *E21B 23/14* (2013.01)

(58) Field of Classification Search

USPC ..... 166/381, 177.6

See application file for complete search history.

(56) References Cited

U.S. PATENT DOCUMENTS

| | | | | |
|---|---|---|---|---|
| 2,840,354 | A * | 6/1958 | McKellar | B06B 1/186 366/124 |
| 3,500,908 | A | 3/1970 | Barler | |
| 4,384,625 | A | 5/1983 | Roger al. | |
| 5,306,980 | A * | 4/1994 | Montgomery | B06B 1/0611 310/325 |
| 5,692,563 | A | 12/1997 | Krueger et al. | |
| 6,152,222 | A | 11/2000 | Kyllingstad | |
| 6,179,527 | B1 * | 1/2001 | Goughnour | E02D 3/10 405/232 |
| 6,550,536 | B2 | 4/2003 | Bernat | |

(Continued)

OTHER PUBLICATIONS

PCT Communication Relating to the Results of the Partial International Searching Authority; dated Oct. 17, 2014; International Application No. PCT/US2013/066291; International File Date: Oct. 23, 2013.

(Continued)

*Primary Examiner* — Taras P Bemko

(74) *Attorney, Agent, or Firm* — Bracewell LLP; Constance Gall Rhebergen

(57) ABSTRACT

A vibrator tool for use in inserting a bottom hole assembly into a wellbore. The vibrator tool includes a substantially cylindrical body, a motor within the substantially cylindrical body, and a non-linear shaft attached to the motor so that the motor turns the non-linear shaft. The non-linear shaft extends outwardly from the motor within the substantially cylindrical body. The vibrator tool further includes a bearing attached to the shaft a predetermined distance from the motor so that the bearing rotates as the non-linear shaft turns. The bearing contacts portions of the inner surface of the cylindrical body as the non-linear shaft turns, thereby vibrating the substantially cylindrical body.

7 Claims, 4 Drawing Sheets

(56) References Cited

U.S. PATENT DOCUMENTS

| | | | | |
|---|---|---|---|---|
| 6,604,583 | B1 * | 8/2003 | Van Randen | B06B 1/166 173/1 |
| 7,066,250 | B2 | 6/2006 | Webb et al. | |
| 7,182,170 | B1 | 2/2007 | Brett et al. | |
| 7,392,855 | B1 * | 7/2008 | White | E02D 7/10 173/135 |
| 2005/0155758 | A1 * | 7/2005 | Webb | E21B 31/005 166/177.6 |
| 2007/0031191 | A1 * | 2/2007 | Quenzi | E01C 19/006 404/118 |
| 2008/0251254 | A1 | 10/2008 | Lynde et al. | |
| 2010/0276204 | A1 | 11/2010 | Connell et al. | |

OTHER PUBLICATIONS

A.E. Schen et al. "Optimization of Bit Drilling Performance Using a New Small Vibration Logging Tool", SPE/IADC 92336 Drilling Conference, Feb. 23-25, 2005, 11 pages.

PCT International Search Report and the Written Opinion; dated Jan. 19, 2015; International Application No. PCT/US2013/066291; International File Date: Oct. 23, 2013.

* cited by examiner

VIBRATOR SUB

BACKGROUND OF THE INVENTION

1. Field of the Invention

The present technology relates to oil and gas wells. In particular, the present technology relates to a vibrator sub for reducing friction between a bottom hole assembly and the inner surfaces of an oil or gas well.

2. Description of the Related Art

Oil wells are typically examined to determine petrophysical properties related to one or more of the well bore, the reservoir it penetrates, and the adjacent formation. Such an examination is typically carried out by a well logging tool, which is lowered to the bottom of the well, and employs electrical, mechanical, and/or radioactive tools to measure and record certain physical parameters. Lowering the logging tool and other equipment (collectively known as the bottom hole assembly) to the bottom of the well can be difficult, particularly in horizontal or deviated portions of wells, where tubing is used to push the bottom hole assembly horizontally through the well bore. One reason for this difficulty is friction between the bottom hole assembly and walls of the well bore. The result of this friction can be that the bottom hole assembly stops progressing toward the bottom of the well. When the bottom hole assembly becomes stuck, the tubing that pushes the bottom hole assembly can buckle.

One known way to overcome this problem is with a well tractor that applies an urging force to the bottom hole assembly. A well tractor is typically a wheeled device that may be included with the bottom hole assembly. When the bottom hole assembly is pushed into the horizontal or deviated portion of the well, and if the friction between the bottom hole assembly and the well begins to slow or stop the progress of the bottom hole assembly toward the bottom of the well, the wheels on the well tractor may turn to drive the bottom hole assembly further into the well. Use of such a well tractor, however, can be problematic. For example, in reservoirs where the rock has low strength, insufficient traction may exist for the tractor to propel the bottom hole assembly toward the bottom of the hole. In addition, well tractors are expensive tools, and there are few companies that produce them.

SUMMARY OF THE INVENTION

One embodiment of the present technology provides a vibrator tool for use in inserting a bottom hole assembly into a wellbore. The vibrator tool includes a substantially cylindrical body, a motor within the substantially cylindrical body, and a non-linear shaft attached to the motor so that as the motor turns the non-linear shaft, the non-linear shaft extends outwardly from the motor within the substantially cylindrical body. The vibrator tool further includes a bearing attached to the shaft a distance from the motor so that the bearing rotates as the non-linear shaft turns, the bearing contacting portions of the inner surface of the cylindrical body as the non-linear shaft turns, thereby vibrating the substantially cylindrical body.

In some embodiments, the motor can turn the shaft at a rate of about 1000-2000 revolutions per minute. In addition, the substantially cylindrical body can have longitudinal slots therein that are positioned to contact the bearing as the bearing rotates so that contact between the bearing and the slots amplifies the vibration of the vibrator tool.

Another embodiment of the present technology provides a vibrator tool for use in inserting a bottom hole assembly into a wellbore. The vibrator tool includes a substantially cylindrical body, a motor attached to the cylindrical body, and a substantially circular gear that rotates radially and that is driven by the motor. The vibrator tool further includes a weight attached to the gear at a position off-center relative to the center of the gear, so that when the gear rotates the off-center attachment of the weight causes the motor and the cylindrical body to vibrate.

Yet another embodiment of the present technology provides a method of inserting logging equipment into a wellbore. The method includes the step of inserting a bottom hole assembly attached to coiled tubing into a wellbore, the bottom hole assembly including a vibrating tool. The vibrating tool includes a non-linear shaft attached to the motor so that the motor turns the non-linear shaft, the non-linear shaft extending outwardly from the motor within the substantially cylindrical body, and a bearing attached to the shaft a predetermined distance from the motor so that the bearing rotates as the non-linear shaft turns, the bearing contacting portions of the inner surface of the cylindrical body as the non-linear shaft turns, thereby vibrating the substantially cylindrical body. The method further includes the steps of lowering the bottom hole assembly through a vertical part of the well, pushing the bottom hole assembly through a deviated part of the well using the tubing, and vibrating the bottom hole assembly and tubing with the vibrating tool to reduce friction between the bottom hole assembly and tubing, and the wellbore.

In some embodiments, the bottom hole assembly can include more than one vibrating tool. In addition, the method can include one or more of the steps of adjusting the distance of the bearing from the motor to increase or decrease vibration, and adjusting the weight of the bearing to increase or decrease vibration.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE EXEMPLARY EMBODIMENTS

Figure 1:
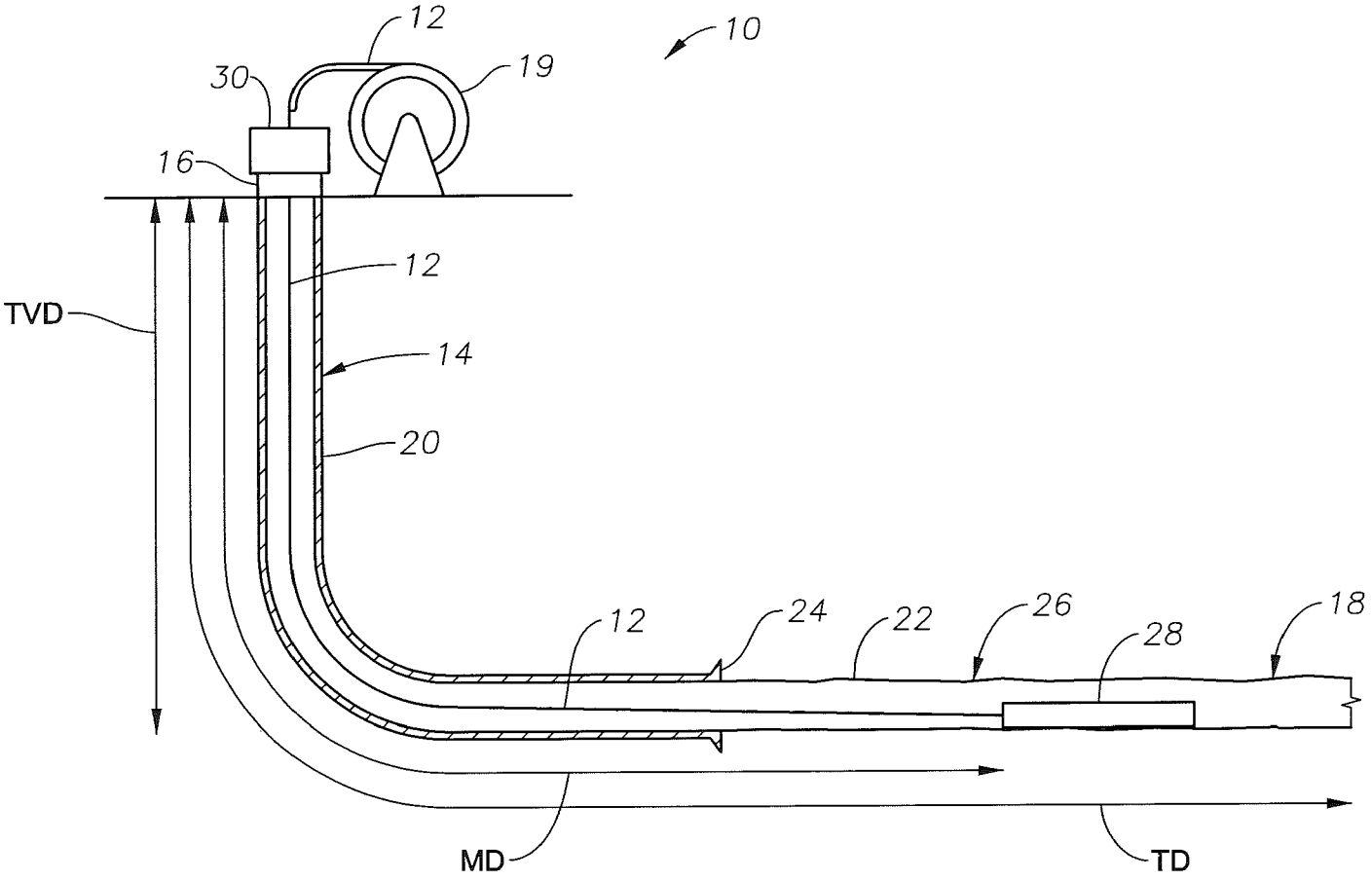
FIG. 1 is a schematic side view of an oil well having a bottom hole assembly inserted therein according to an embodiment of the present technology.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the embodiments are not intended to be limited to the specific terms used, and it is to be understood that each specific term includes equivalents that operate in a similar manner to accomplish a similar purpose.

FIG. 1 shows a schematic view of an example of an example of a well logging assembly 10. The well logging assembly 10 of FIG. 1 includes tubing 12 that extends through a well 14 from the wellhead 16 toward the bottom of the well 18. Prior to entry into the well 14, the tubing 12 is coiled around a coiled tubing reel 19. The well 14 can include a vertical section 20 and a horizontal or deviated section 22. The length of the vertical section 20 of the well 14 is known as the true vertical depth TVD, and the length of the well 14 from the wellhead 16 to the bottom of the well 18 is known as the total well depth TD. Typically, the well 14 is cased with a casing (not shown) that extends along a substantial portion of the wellbore from the wellhead downward, terminating at a casing shoe 24. Below the casing shoe 24 is an open hole section 26 of the well 14.

There is attached to end of the tubing 12 a bottom hole assembly 28, which, in the embodiment shown in FIG. 1, includes a logging tool. The logging tool can include mechanical, electrical, and/or radioactive equipment to record physical measurements that are then interpreted to provide a description of the petrophysical properties of the wellbore, the reservoir, and/or the formation. The length of the well 14 from the wellhead 16 to the bottom hole assembly 28 is known as the measured depth MD.

As the tubing 12 is unwound from the coiled tubing reel 19, the bottom hole assembly 28 is lowered into the well 14. In the vertical portion 20 of the well 14, the weight of the bottom hole assembly 28 pulls the bottom hole assembly 28 and its attached tubing 12 into the well 14. In wells having no deviated portion, the weight of the bottom hole assembly 28 alone may be sufficient to bring the bottom hole assembly 28 to the bottom 18 of the well 14. However, in wells having a horizontal or deviated portion 22, the coiled tubing 12 typically pushes the bottom hole assembly 28 further into the well 14 to move the bottom hole assembly 28 through the horizontal or deviated portion 22 of the well 14. Typically, an injector 30 can be included to force the tubing 12 into the well once the bottom hole assembly 28 reaches the horizontal or deviated portion 22 of the well 14.

As the bottom hole assembly 28 and the end of the tube 12 progress through the horizontal or deviated portion 22 of the well 14, friction can develop between the bottom hole assembly 28 and the walls of the well 14. As friction between these components increases, the injector 30 must exert more and more force on the tubing 12 to continue pushing the bottom hole assembly 28 deeper into the well 14. If the frictional forces between the bottom hole assembly 28 and the walls of the well 14 become greater than the force exerted on the tubing by the injector 30, forward progress of the bottom hole assembly 28 into the well 14 can slow or stop. In this situation, the bottom hole assembly 28, including the logging tool 29, cannot reach the bottom of the well 18 to record the required measurements. In addition, such a situation can lead to the tubing 12 buckling as the bottom hole assembly 28 stops progressing at the same rate as the tubing 12.

Figure 2:
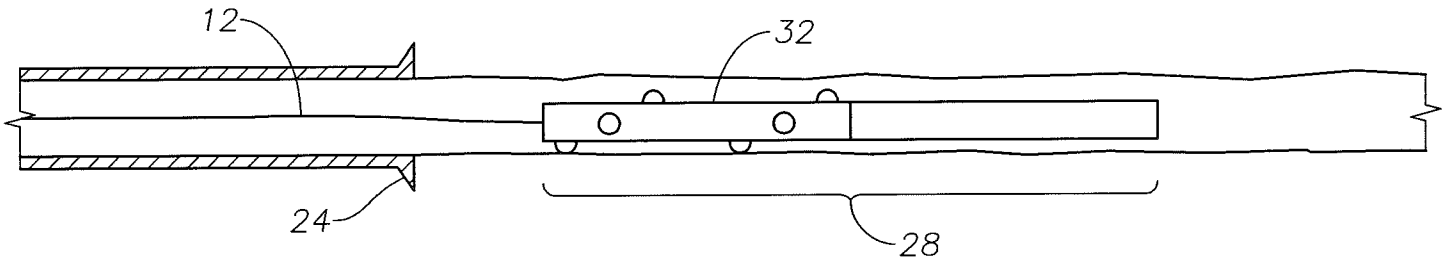
FIG. 2 is a schematic side view of the deviated portion of a well bore having a bottom hole assembly with a well tractor inserted therein according to an embodiment of the present technology.

As shown in FIG. 2, to overcome the problem of buckled tubing 12, and to help the bottom hole assembly 28 progress down the well 14, a well tractor 32 can be included in the bottom hole assembly 28. The well tractor 32 is a piece of equipment attached to the logging tool and the tubing, and having wheels that can engage the surface of the well 14. The wheels can be powered by, for example, hydraulics. As the wheels of the well tractor 32 turn, the well tractor 32 can push the rest of the bottom hole assembly 28 further downhole. One disadvantage to the well tractor 32, however, is that where the reservoir rock in the open hole section 26 has low strength, it is possible that the well tractor wheels cannot obtain adequate traction in the soft formation to push the bottom hole assembly 28 further into the well 14.

Figure 3:
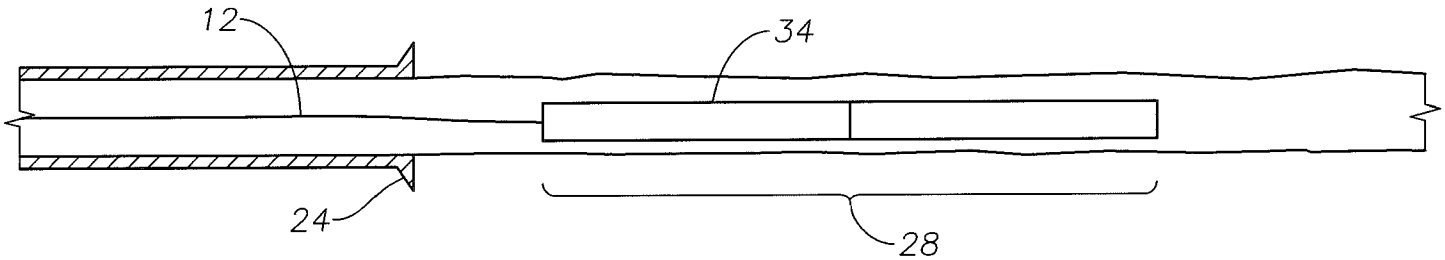
FIG. 3 is a schematic side view of the deviated portion of a well bore having a bottom hole assembly with a vibrator sub tool inserted therein according to an embodiment of the present technology.

Referring now to FIG. 3, there is shown an embodiment of the present technology in which a vibrating sub tool 34 is included in the down hole assembly 28 to help the bottom hole assembly 28 progress down a well 14. The vibrating sub tool 34 can help the bottom hole assembly 28 to progress in situations where, for example, the frictional forces between the bottom hole assembly 28 or tubing 12 and the well 14 are greater than the forces exerted on the tubing 12 by the injector 30, as discussed above.

The vibrating sub tool 34 is a tool that can produce vibration. This vibration can be manifested in the shaking or agitation of the vibrating sub tool 34 relative to the well 14, and has the tendency to cause the vibrating sub tool 34 to rapidly move or oscillate relative to the well 14, thereby decreasing contact and, as a result, frictional forces, between the vibrating sub tool 34 and the well 14. In some embodiments, the vibration can be enough to separate the vibrating sub tool 34 from surfaces of the well. This vibration can in turn provide vibration or agitation to the bottom hole assembly 28 and tubing 12, thereby reducing frictional forces between the bottom hole assembly 28 and tubing 12, and the well 14 in the same way. When the frictional forces are less than the forces exerted on the bottom hole assembly 28 by the injector 30 and the tubing 12, the down hole assembly 28 can continue to move down hole. If desired, multiple vibration sub tools 34 can be deployed in the same well 14, thereby increasing the amount of vibration and further reducing friction between the bottom hole assembly 28 and tubing 12, and the well 14.

Figure 4:
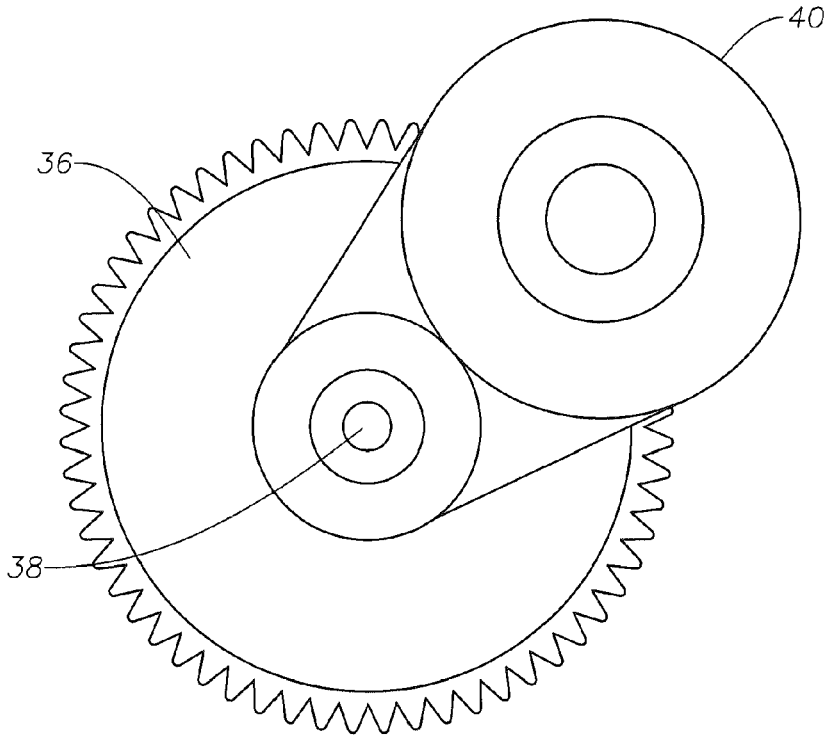
FIG. 4 is a perspective view of a gear and weight of a vibrator tool according to an embodiment of the present technology.

Vibration of the vibrating sub tool 34 can be caused by a motor, which, in one possible embodiment, can be structured in a similar way to the arrangement shown in FIG. 4. In FIG. 4, there is shown an arrangement in which a motor (not shown) drives a gear 36 with a motor shaft 38. A weight 40 is attached to the gear 36 in a position off-center from the center of the gear 36. When the motor spins the gear 36 at a high rate of speed, the off-center weight 40 causes a vibration. The magnitude of this vibration can be controlled by adjusting the size of the weight 40, or the position of the weight 40 relative to the gear 36 and the shaft 38.

Figure 5:
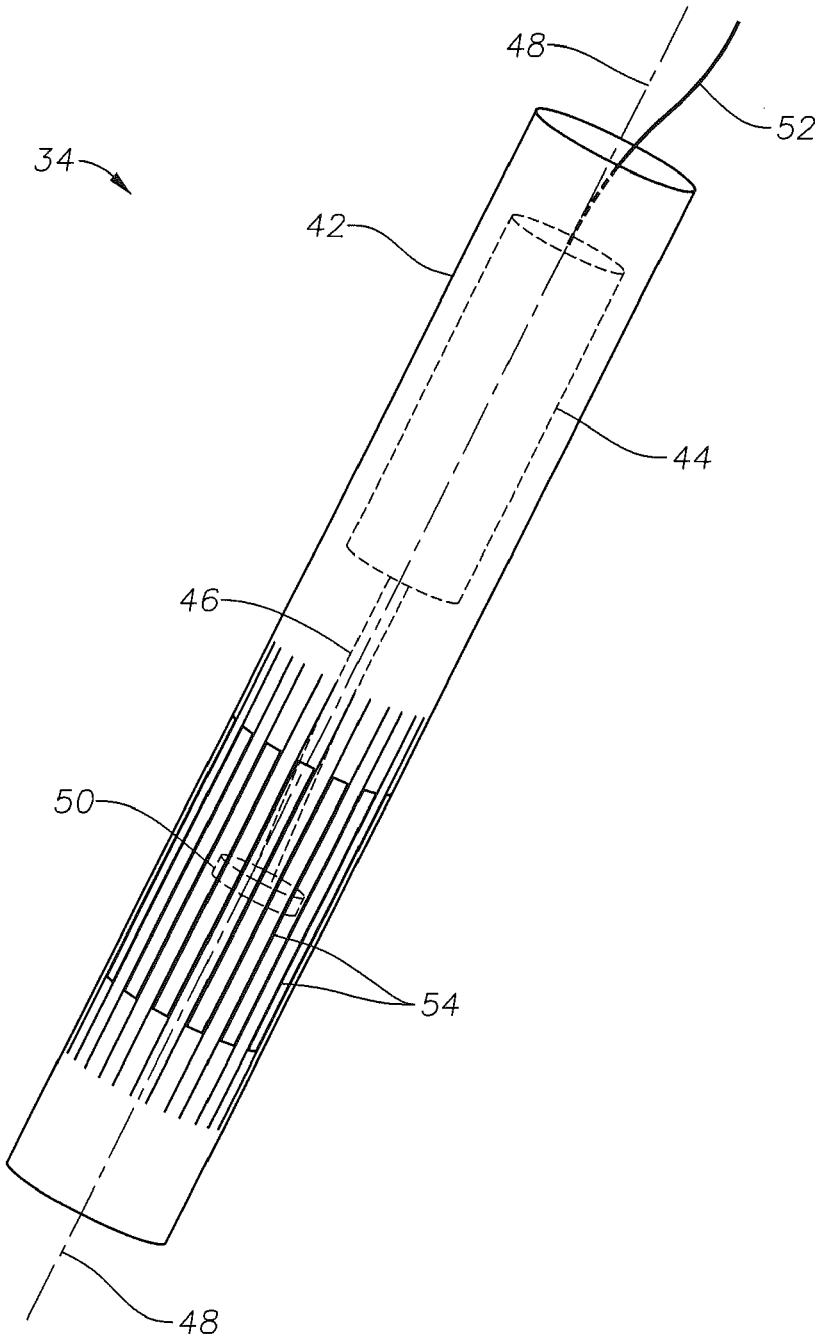
FIG. 5 is a perspective view of a vibrator sub tool according to another embodiment of the present technology.

Another embodiment of the vibrating sub tool 34 is shown in FIG. 5. In this embodiment, the vibrating sub tool 34 has a body 42 that encloses an electric motor 44 having a shaft 46 extending therefrom. The shaft 46 is not straight, but is curved or bent relative to a longitudinal axis 48 of the body 42. A bearing 50 can be attached to the end of the shaft 46, and can connect the shaft 46 to the body 42. Because the shaft 46 is curved or bent, the bearing 50 is off-center from the longitudinal axis 48. The motor 44 can be connected to an electric cable 52 that provides power to the motor 44 so that the motor 44 can turn the shaft 46. In practice, the motor 44 turns the shaft 46, which in turn rotates the bearing 50 around the inside of the body 42. The bearing 50 can contact the inside surfaces of the body 42, thereby increasing the vibration of the vibrating sub tool 34. In one example embodiment, the motor 34 rotates the shaft at a rate of about 1000-2000 revolutions per minute (rpm). Because the bearing 50 is off center, the rotating of the bearing 50 causes the body 42 to vibrate.

The embodiment of FIG. 5 can also include one or more vibrating slots 54, positioned circumferentially at intervals around the body 42. The vibrating slots 54 can be positioned adjacent the bearing 50, so that as the shaft 46 and bearing 50 rotate, the bearing contacts the vibrating slots 54. The vibrating slots 54 can be created by cutting the body 42 longitudinally at intervals around the circumference of the body 42. Alternatively, the vibrating slots 54 can be created by cutting away and removing portions of the body 42. Thus configured, contact between the bearing 50 and the vibrating slots 54 will cause the remaining portions of the body 42 adjacent the slots 54 to vibrate at a greater amplitude than the rest of the body 42, thereby amplifying the vibration of the body 42, and increasing the vibration of the vibrating sub tool 34 as a whole. As discussed above, vibration of the vibrating sub tool 34 leads to vibration of the coiled tubing 12 and other components of the bottom hole assembly 28.

Use of a vibration sub tool 34 to reduce friction between the tubing 12, bottom hole assembly 28, and the well 14 can be advantageous compared to the well tactor 32, because the vibrating sub tool 34 has few parts and can be manufactured and installed more economically. In addition, the vibration sub tool 34 has the ability to move the bottom hole assembly 28 even when the reservoir rock is of low strength, a condition that could preclude the use of a well tractor 32.

In practice, the vibrating sub tool 34 of the present technology can be used according to the following method. Initially, the bottom hole assembly 28, including the vibrating sub tool 34, can be lowered into the well 14. As the bottom hole assembly 28 passes through the vertical section 20 of the well 14, the weight of the bottom hole assembly itself can pull the bottom hole assembly 28 downward toward the bottom 18 of the well 14. Upon reaching the horizontal or deviated section 22 of the well 14, the tubing 12 attached to the bottom hole assembly 28 can begin pushing the bottom hole assembly 28 horizontally through the well 14. If desired, such as when the frictional forces between the bottom hole assembly 28 and the well 14 exceed the force exerted on the bottom hole assembly 28 by the tubing 12, the vibrating sub tool 34 may be activated and begin to vibrate. This vibration can agitate the bottom hole assembly 28 and tubing 12, thereby reducing the amount of friction between the tubing 12, bottom hole assembly 28, and the well 14 so that the tubing 12 can continue to push the bottom hole assembly 28 toward the bottom 18 of the well 14.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A vibrator tool for use in inserting a bottom hole assembly into a wellbore, the vibrator tool comprising:

a substantially cylindrical body;

a motor within the substantially cylindrical body;

a non-linear shaft attached to the motor so that as the motor turns the non-linear shaft, the non-linear shaft extends outwardly from the motor within the substantially cylindrical body; and a bearing attached to the shaft a distance from the motor so that the bearing rotates as the non-linear shaft turns, the bearing contacting portions of the inner surface of the cylindrical body as the non-linear shaft turns, thereby vibrating the substantially cylindrical body;

wherein the substantially cylindrical body has longitudinal slots therein that are positioned to contact the bearing as the bearing rotates so that contact between the bearing and the slots amplifies the vibration of the vibrator tool.

2. The vibrator tool of claim 1, wherein the motor turns the shaft at a rate of about 1000-2000 revolutions per minute.

3. A vibrator tool for use in inserting a bottom hole assembly into a wellbore, the vibrator tool comprising:

a substantially cylindrical body;

a motor attached to the cylindrical body;

a substantially circular gear that rotates and that is driven by the motor; and a weight attached to the gear at a position off-center relative to the center of the gear, so that when the gear rotates the off-center attachment of the weight causes the motor and the cylindrical body to vibrate, wherein the weight is outside of, and spaced apart from, a center of rotation of the gear.

4. A method of inserting logging equipment into a wellbore, the method comprising the steps of:

inserting a bottom hole assembly attached to coiled tubing into a wellbore, the bottom hole assembly including a vibrating tool, the vibrating tool comprising:

a substantially cylindrical body;

a motor within the substantially cylindrical body;

a non-linear shaft attached to the motor so that the motor turns the non-linear shaft, the non-linear shaft extending outwardly from the motor within the substantially cylindrical body; and a bearing attached to the shaft a predetermined distance from the motor so that the bearing rotates as the non-linear shaft turns, the bearing contacting portions of the inner surface of the cylindrical body as the non-linear shaft turns, thereby vibrating the substantially cylindrical body;

wherein the substantially cylindrical body has longitudinal slots therein that are positioned to contact the bearing as the bearing rotates so that contact between the bearing and the slots amplifies the vibration of the vibrator tool;

lowering the bottom hole assembly through a vertical part of the wellbore;

pushing the bottom hole assembly through a deviated part of the wellbore using the tubing; and vibrating the bottom hole assembly and tubing with the vibrating tool to reduce friction between the bottom hole assembly and tubing, and the wellbore.

5. The method of claim 4, wherein the bottom hole assembly includes more than one vibrating tool.

6. The method of claim 4, further comprising:

adjusting the distance of the bearing from the motor to increase or decrease vibration.

7. The method of claim 4, further comprising:

adjusting the weight of the bearing to increase or decrease vibration.

* * * * *